United States Patent [19]

Riordan et al.

[11] 4,455,589

[45] Jun. 19, 1984

[54] FUEL VALVE LATCH OUT SYSTEM

[75] Inventors: William J. Riordan, Shrewsbury; Charles Collins, North Grafton, both of Mass.

[73] Assignee: Kidde, Inc., Clifton, N.J.

[21] Appl. No.: 395,863

[22] Filed: Jul. 6, 1982

[51] Int. Cl.[3] ..... H01H 47/22

[52] U.S. Cl. ..... 361/190; 431/67

[58] Field of Search ..... 431/67, 69–71, 431/24, 25, 66; 361/189, 190, 90, 265

[56] References Cited

U.S. PATENT DOCUMENTS

| | | | |
|---|---|---|---|
| 3,584,988 | 6/1971 | Hirsbrunner et al. | 431/66 |
| 3,600,117 | 8/1971 | Hirsbrunner | 431/66 |
| 3,900,770 | 8/1975 | Kaufman | 361/190 X |
| 4,298,335 | 11/1981 | Riordan et al. | 431/67 X |

*Primary Examiner*—Harry E. Moose, Jr.

*Attorney, Agent, or Firm*—John E. Toupal; Harold G. Jarcho

[57] ABSTRACT

An electrical control system including a source of electrical power and an electrical load coupled together by a power switch having alternate circuit open and circuit closed conditions. A closure means activates the power switch to a circuit closed condition to produce power transmission between the source and the load in response to a closure signal produced by a condition responsive control circuit. Connected in series with the power switch is a protective switch also activated from a circuit open to a circuit closed condition in response to the closure signal. A sensing circuit produces a fault signal in response to a closed condition of the power switch and a simultaneous circuit open condition of the protective switch.

19 Claims, 3 Drawing Figures

FUEL VALVE LATCH OUT SYSTEM

BACKGROUND OF THE INVENTION

This invention relates generally to burner control systems and, more particularly, to fuel valve control circuits.

Extensive efforts have been directed toward improving control systems for fuel burners such as gas and oil burners and the like. Increased system safety and reliability have been primary objectives of such efforts.

Most burner systems employ fuel supply valves that are automatically controlled by start-up circuits and some type of flame detecting mechanism that automatically interrupts fuel flow in response to a predetermined loss of flame condition. Typical start-up circuits initiate fuel flow only after a delay period provided, for example, to permit purging of previously discharged fuel or activation of a fuel ignition system. The more serious problems caused by malfunctions in these circuits are either a premature opening of the valve or a retention thereof in an open position in the absence of flame. Many circuits have been developed that include numerous safeguards to insure that such unsafe conditions will not result if one or more circuit components fail. However, prior control circuits have not prevented unsafe operation in the event that the relay contacts energizing the valve solenoid are inadvertently closed. Such a situation can exist, for example, when contacts become welded closed.

An object of this invention therefore, is to provide a failsafe valve control system that will prevent unsafe conditions upon an inadvertent closure of relay contacts connected to a valve solenoid. A further object is to establish a positive lock out in response to such a condition.

SUMMARY OF THE INVENTION

The present invention is directed toward an electrical control system including a source of electrical power and electrical load coupled together by a power switch having alternate circuit open and circuit closed conditions. A closure means activates the power switch to a circuit closed condition to produce power transmission between the source and the load in response to a closure signal produced by a condition responsive control circuit. Connected in series with the power switch is a protective switch also activated from a circuit open to a circuit closed condition in response to the closure signal. A sensing circuit produces a fault signal in response to a closed condition of the power switch and a simultaneous circuit open condition of the protective switch. The system produces the fault signal in the event that the power switch inadvertently remains in a closed circuit condition in the absence of a closure signal from the condition responsive control.

According to one feature of the invention, the system includes a shut-down circuit for deactivating the condition responsive control circuit in response to the fault signal. Manual intervention is required for a resumption of system operation after a shutdown caused by an inadvertent closed condition of the power switch.

According to another feature of the invention, the system is a fuel-burner control system including a valve for controlling the flow of fuel to a burner and the electrical load is a solenoid for opening the valve. This system prevents potentially dangerous flow of fuel in response to an inadvertent closure of the power switch.

In one embodiment of the invention, the power switch includes relay contacts connected between the source and the load and the closure means is a relay winding energized in response to the closure signal to position the contacts in the closed circuit condition. Preferably, the protective switch is a triac activated into a conductive condition by the closure signal.

In another embodiment of the invention, the power switch is an electronic switch connected between the source and the load and activated into a conductive condition by the closure signal. As above, the protective switch preferably is a triac activated to conductive condition by the closure signal.

According to another feature of the invention, the sensing circuit also produces an error signal in response to an open condition of the power switch and a simultaneous circuit closed condition of the protective switch. The error signal also causes shutdown of the condition responsive circuit.

In a preferred embodiment, an initiator energizes the system and the condition responsive circuit produces the closure signal a predetermined time delay period thereafter. The sensing circuit senses the voltage at a point between the power and protective switches and produces the fault signal in response to a sensed level above a given maximum value and produces the error signal in response to a sensed level below a given minimum value.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
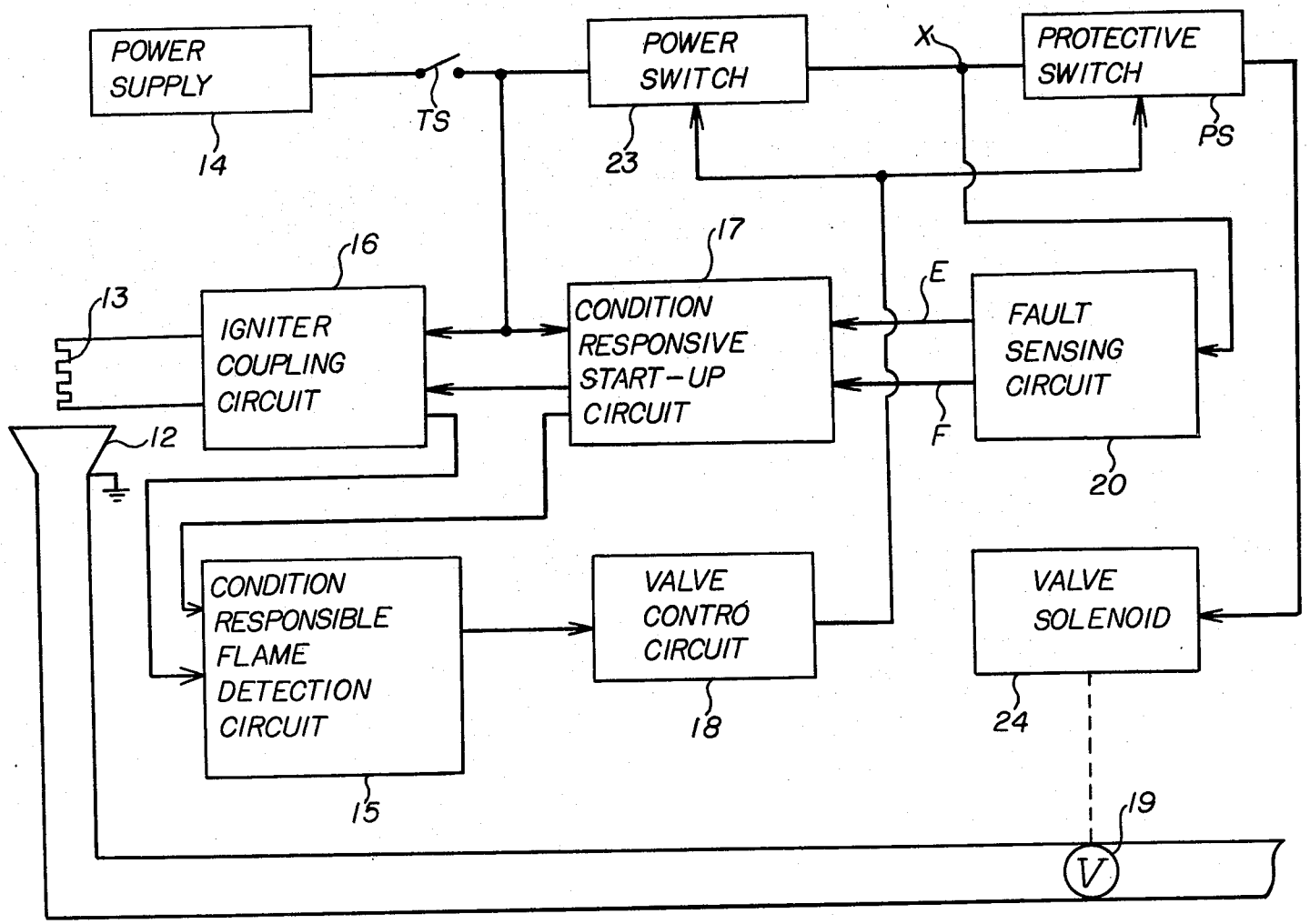
FIG. 1 is a schematic block diagram illustrating functional aspects of the invention.

Schematically illustrated in FIG. 1 is a system 11 for controlling the operation of a fuel burner 12. Included in the system 11 is a resistive heating element 13 that can ignite fuel emanating from the burner 12 after being heated to ignition temperature by current supplied by a power supply 14. Also included in the system 11 is a condition responsive flame detection circuit 15 that detects and responds to flame rectified current passing between the heater element 13 and the grounded burner 12. The flame detection circuit 15 is shown in greater detail in FIG. 2 and is described more fully below. An ignitor coupling circuit 16 interconnects the heater element 13 with both the power supply 14 and the flame detection circuit 15. As also described more fully below, the coupling circuit 16 prevents the flow of current between the power supply 14 and the flame detection circuit 15 thereby permitting the alternate use of the heater element 13 as both a source of ignition and as an electrode for deriving flame rectified current.

The system 11 also includes a condition responsive start-up circuit 17 and a valve control circuit 18. As described below, the start-up circuit 17 can be initiated by closure of a thermostatic switch TS to produce a predetermined heating period during which a heating signal is applied to the coupling circuit 16 and a given ignition period during which an ignition signal is applied to the flame detection circuit 15. In response to the heating signal, the coupling circuit induces the flow of current between the power supply 14 and the element 13 so as to produce heating thereof to ignition temperature. After a period required for the element 13 to reach ignition temperature, the ignition signal from the start-up circuit 17 causes the flame detection circuit 15 to provide a closure signal to the valve control circuit 18. In response to the closure signal, the valve control circuit 18 produces closed circuit conditions for both a power switch 23 and a protective switch PS thereby initiating power transmission to a solenoid load 24. Energization of the solenoid 24 induces opening of a valve 19 that supplies fuel to the burner 12.

Immediately after being activated by the thermostatic switch TS and prior to the closure signal, however, a sensing circuit 20 monitors the voltage level at a point X between the power switch 23 and the protective switch PS. In response to a voltage level above a given maximum value, a fault signal is produced on a line F that causes positive shutdown of the system 11 to prevent opening of the valve 19. Similarly, a sensed voltage level below a given minimum value results in an error signal on a line E that causes shutdown. After ignition of fuel emanating from the burner 12, the flow of flame rectified current between the element 13 and the flame detection circuit 15 occurs via the coupling circuit 16 which additionally prevents the loss of that current into the power supply 14. Thus, the heater element 13 serves the dual sequential functions of an ignitor for igniting fuel at the burner 12 and an electrode for deriving flame rectified current for the flame sensing circuit 15.

Figure 2:
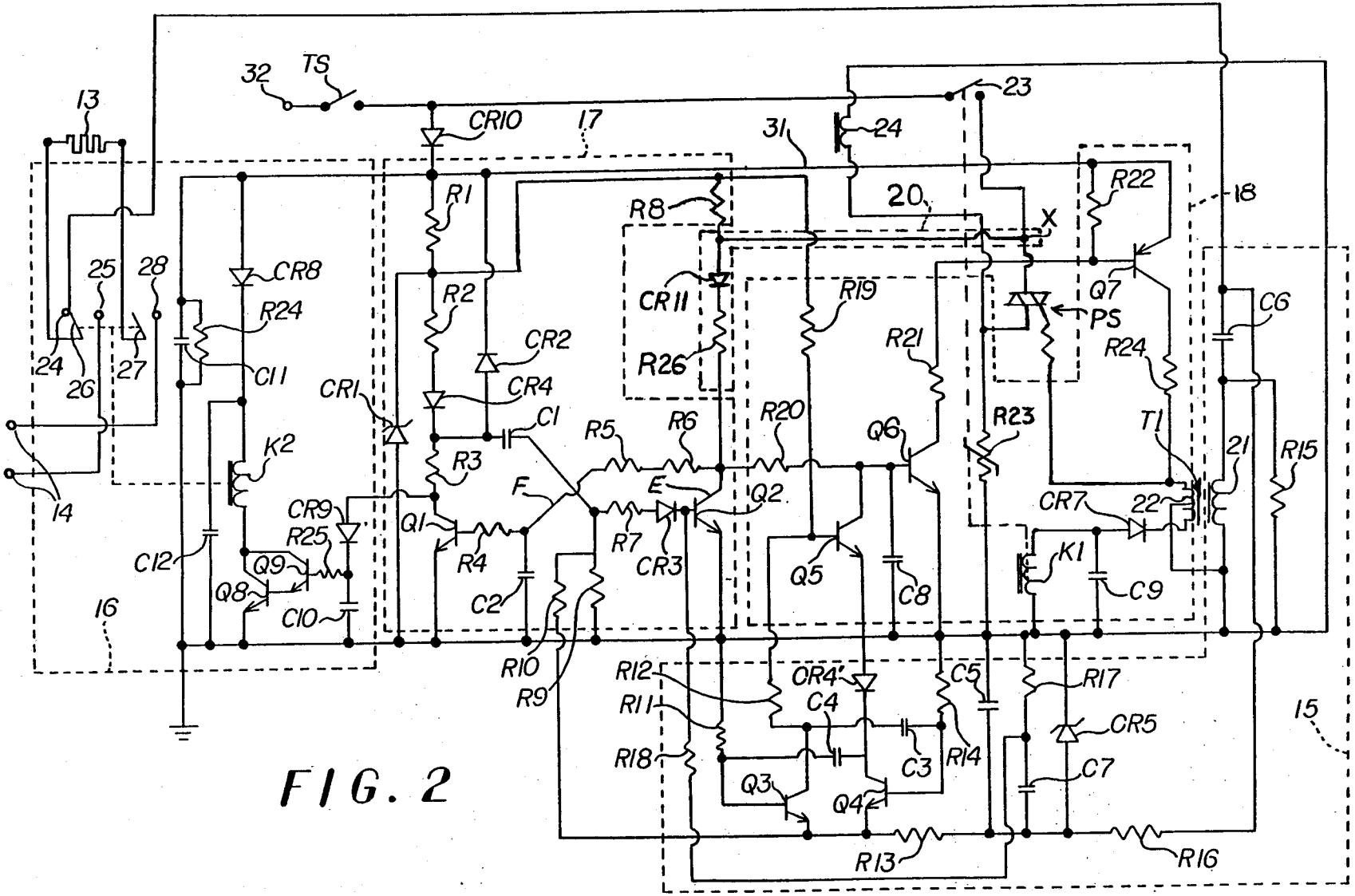
FIG. 2 is a schematic circuit diagram showing details of the circuits represented by the blocks in FIG. 1.

Referring now to FIG. 2 there is shown in greater detail the circuits depicted by blocks in FIG. 1. The start-up circuit 17 includes a basic multi-vibrator consisting of a pair of transistors Q1 and Q2 and associated resistors R1–R10, capacitors C1, C2, and diodes, CR1–CR4. Included in the flame detection circuit 15 is a conventional multi-vibrator consisting of a pair of transistors Q3 and Q4 and associated resistors R11–R14, capacitors C3–C5 and diodes CR4 and CR5. Also included in the flame detection circuit 15 is a detector network composed of a primary energy storing capacitor C6, a pair of resistors R15, R16 and a secondary winding 21 of a transformer T1. A reignition mechanism composed of a secondary storage capacitor C7 and resistors R17 and R18 also is included in the flame detection circuit 15. The valve control circuit 18 includes three transistors Q5–Q7, the primary winding 22 of the transformer T1, a relay winding K1 and its associated contacts 23, a solenoid 24 associated with the valve 19, resistors R19–R22, a metal oxide varistor R23, capacitors C8 and C9 and a pair of diodes CR6 and CR7. Finally, the coupling circuit 16 includes a pair of transistors Q8, Q9, a relay winding K2 and its associated contacts 24–28, resistors R24, R25 capacitors C10–C12, and diodes CR8 and CR9. A supply line 31 for the circuits 15–18 is connected to an ac source 32 by a thermostatic switch TS and a diode CR10. Forming the sensing circuit 20 is a resistor R26 and a diode CR11.

OPERATION OF THE INVENTION

In response to a call for heat indicated by closure of the thermostat TS, the start-up circuit 17 first activates the ignitor coupling circuit 16 with a heating signal to initiate energization of the heater element 13 and subsequently produces an ignition signal that is applied to the flame detection circuit 15. In response to the ignition signal, the detection circuit 15 activates the valve control circuit 18 which in turn opens the valve 19 to initiate gas flow to the burner 12. This operation occurs in the following manner. Current from the supply 32 flows through the thermostat TS, the diode CR10, the resistors R1, R2, the diode CR4 so as to charge the capacitor C1 through the resistor R7 and the diode CR3 into the base of the transistor Q2. This current flow turns on the transistor Q2. Conversely, a current attempts to flow through the resistors R8, R6, R5, and R4 to the base of the transistor Q1. The capacitor C2, however, acts as a delay preventing an immediate turn on of the transistor Q1.

The turned on transistor Q2 serves as a short to ground also for current flow through the resistors R5, R6. With the transistor Q1 turned off, a heating signal is supplied from its collector through the diode CR9 and the resistor R25 into the bases of the transistors Q9 and Q8. Accordingly the transistor Q8 is turned on to draw energizing current through the relay K2 and initiate a heating period. The activation of the relay K2 induces closure of contacts 25, 26 and 27, 28 thereby connecting the heater element 13 to the power supply 14. The resultant current flow produces heating of the element 13 which can consist, for example, of a silicon carbide rod. After a period of, for example, 45 seconds, sufficient for the element 13 to reach fuel ignition temperature, the capacitor C1 is charged to a level that provides insufficient current flow to maintain conduction of the transistor Q2. That time period is determined by the time constant of the capacitor C1 and the resistors R1, R2 and R7. With the transistor Q2 switched off, its collector current is diverted through the resistors R6, R5 and R4 into the base of the transistor Q1 which switches on virtually tying the plus side of the capacitor C1 to ground. The capacitor C1 then provides an ignition signal that energizes the oscillator in the sensing circuit 15. Power for the oscillator is drawn from the capacitor C1 through the resistor R3 and the transistor Q1 to ground and from ground through the transistors Q3, Q4 and their collector and base components and finally back through the resistor R10. Power to amplify the output of the oscillator is taken from the collector of the transistor Q3 which is connected to the base of the transistor Q5.

The resistor 19 normally biases the transistor Q5 in a switched on condition which in turn maintains the transistors Q6 and Q7 in the off state. However, with the oscillator running, the current taken from the resistor R12 pulls current away from the resistor R19 so as to turn off the transistor Q5. Current is then allowed to flow through the resistor R20 and the base of the transistor Q6 which is switched on and draws current through the base of the transistor Q7 through the resistor R21. Thus, the transistor Q7 is switched on and off at the frequency of the oscillator and produces current through the resistor 24 that pulses the transformer T1. With the transistor Q7 on, the relay K1 is powered by transformer action through the diode CR7 and closes the power contacts 23. The capacitor C9 functions as a filter for the relay K1. In addition, the connection between the resistor R24 and the gate of the protective switch PS produces triggering thereof. Energization of the relay K1 closes the contacts 23 which with the switched on triac PS provides a path to energize the solenoid 24 and open the valve 19 to initiate fuel flow to the burner 12. Fuel emanating from the burner 12 is then ignited by the heater element 13. Thus the valve solenoid 24 can be powered only if both the relay coil K1 and the transistor Q7 are operating normally.

To insure that the heater element 13 will remain at ignition temperature during the ignition period, a means is provided for maintaining heating current flow for a limited period after the transistor Q1 has been switched on to initiate the ignition period. This means comprises the capacitor C10, the charge in which continues to supply base current for the transistor Q9 and thereby maintain energization of the relay K2. The capacitor C10 provides an additional heating period of, for example, five seconds after initiation of the ignition period established by switching on of the transistor Q1. Discharge of the capacitor C10 terminates the heating period by de-energizing the relay K2 to disconnect the heater element 13 from the supply 14.

In addition to disconnecting the heater element 13 from the power supply 14, de-energization of the relay K2 causes closure of the contacts 24, 26 thereby connecting the element 13 to the flame sensing circuit 15. Once so connected, the heater element 13 functions as an electrode for deriving flame rectified current as described hereinafter. This function is made possible by the coupling circuit 16 that prevents the flow of current between the sensing circuit 15 and the power supply 14.

Discharge of the capacitor C1 terminates the ignition period by eliminating the application of an ignition signal to the detection circuit 15. The length of the ignition period, for example, six seconds, is slightly longer than the extended heating period provided by discharge of the capacitor C10 so as to insure that the heater element 13 has become operational in the detection circuit 15. In the event that flame is not established at the burner 12 during the ignition period, the discharge of the capacitor C1 eliminates power for operating the oscillator in the detection circuit 15. Consequently, the transistor Q5 is switched on to thereby switch off the transistors Q6 and Q7 and de-energize the relay K1. This in turn opens the contacts 23 and de-energizes the solenoid 24 to close the valve 19 and interrupt any additional fuel flow to the burner 12. In this locked out condition, a subsequent try for ignition can be accomplished only by reopening and closing of the termostat TS.

Assuming however, that flame is established at the burner 12 during the ignition period, the detection circuit 15 detects that flame and provides power to the oscillator that maintains a flow of fuel. As is well known, flame functions as a leaky diode which in this instance appears between the heater element 13 and the grounded burner 12. Thus, the ac voltage applied to the element 13 by the secondary winding 21 produces a rectified current flow that charges the capacitor C6. The direction of that current flow is such that the transformer side of the capacitor C6 is positive and the side connected to the heater element 13 by the coupling circuit 16 is negative. The charge on the capacitor C6 is transferred through the resistor R16 to the capacitor C5 which acts to filter out any ac provided by the transformer T1. The capacitor C6 then supplies the oscillator with power through the resistor R13. Once the oscillator is started and flame continues, there exists a self-generating loop that insures a continued flow of fuel. However, if flame is subsequently lost, the flame rectified current is lost and the capacitor C6 quickly discharges eliminating any source of power for the oscillator.

To minimize nuisance lockouts after losses of flame, the present invention provides a means for reignition in the sensing circuit 15. The reignition function is provided in the sensing circuit 15 by the capacitors C5, C7 and the resistor R17. When flame is lost, the very small capacitors C7 and C5 quickly discharge and the oscillator stops in a very short period of, for example, less than a second, to thereby close the valve 19 and interrupt fuel flow to the burner 12. However, the capacitor C5 discharges into the oscillator and a discharge path for the capacitor C7 exists through the resistor R18 to the base of the transistor Q2 to ground, and through the oscillator. The resultant current flow turns on the transistor Q2 initiating a complete new start-up sequence in the manner described above. In the event that the subsequent start-up cycle fails to re-establish flame, system lockout will occur as above described.

Assume next that the contacts 23 are inadvertently closed at the time the thermostat TS closes to demand heat. This potentially dangerous condition could result, for example, from an inadvertent welding of the relay contacts 23 in a closed position. In that event, full line voltage is applied to the point X between the relay contacts 23 and the protective switch PS. That abnormally high voltage is sensed by the sensing circuit 20 and applied to the collector of the transistor Q2 to produce fault signal current flow to the base of the transistor Q1 via line F and the resistors R4, R5 and R6. The immediate switching on of the transistor Q1 prevents charging of the delay capacitor C1 and results in deactivation of the condition responsive start-up circuit 17 and positive lockout of the entire system 11, as previously described.

In addition to protecting against inadvertent closure of the power contacts 23, the sensing circuit 20 effects system shutdown if the protective triac PS becomes inadvertently shorted. In that case, the point X is effectively shunted by the shorted protective switch PS and the relatively low resistance solenoid coil 24. The abnormally low voltage at the point X is applied by the sensing circuit 20 as an error signal to the collector of the transistor Q2 via the line E. Held off by the low collector voltage, the transistor Q2 prevents charging current flow to the delay capacitor C1. Thus, inadvertent shorting of the protective switch PS also results in deactivation of the start up circuit 17 and positive lock out of the system 11.

Figure 3:
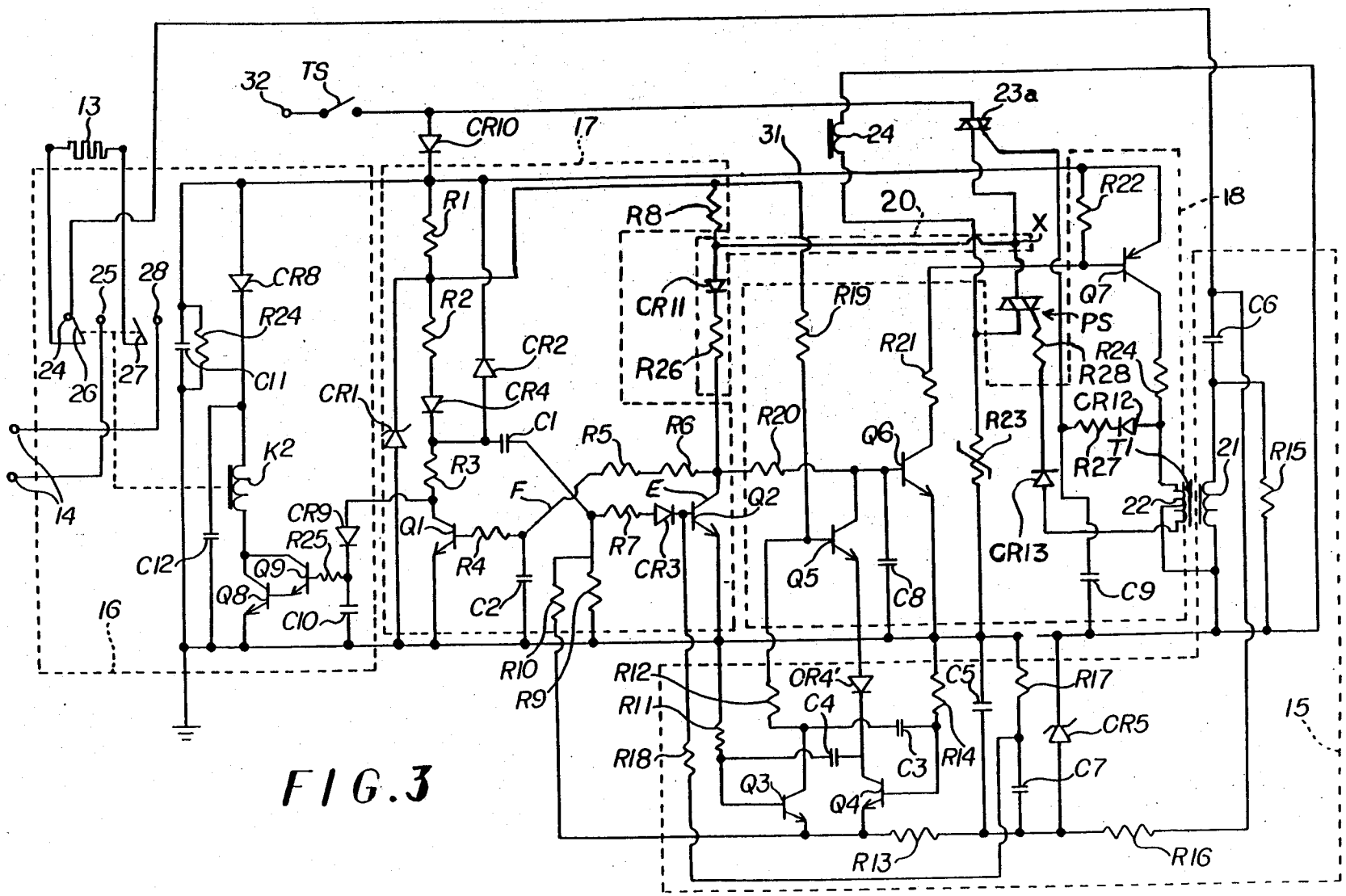
FIG. 3 is a schematic circuit diagram illustrating a modified embodiment.

FIG. 3 shows another embodiment in which components identical to those shown in FIG. 2 bear the same reference numerals. In this embodiment, the relay K1, 23 is replaced by a triac power switch **23*a* having a gate connected to the resistor R24 by a resistor R27 and a diode CR12. The gate of the triac protective switch PS is connected to the primary winding 22 by a resistor R28 and a diode DR13. Switching on of the transistor Q7 triggers both of the triacs 23*a* and PS into circuit closed condition to provide an energization path for the solenoid 24. As above, the sensing circuit 20 monitors the point X and produces either a fault or an error signal, respectively, in response to shorting of the power triac 23*a* or the protective triac PS. In either case, the start-up circuit is deactivated as described above to shut down the system 11**.

Obviously, many modifications and variations of the present invention are possible in light of the above teachings. It is therefore to be understood that within the scope of the appended claims that invention can be practiced otherwise than as specifically described.

What is claimed is:

1. An electrical control system comprising;
a source of electrical power;
an electrical load;
power switch means coupled between said source and said load and having alternate circuit open and circuit closed conditions;
closure means for activating said power switch means to said circuit closed condition to produce power transmission between said source and said load;
condition responsive control means for producing a closure signal that activates said closure means to produce said closed circuit condition in response to a given condition;
protective switch means connected in series with said power switch means and activated from a circuit open to a circuit closed condition in response to said closure signal; and
sensing circuit means for producing a fault signal in response to said closed condition of said power switch means and a simultaneous circuit open condition of said protective switch means.

2. A system according to claim 1 including shutdown circuit means for deactivating said condition responsive control means in response to said fault signal.

3. A system according to claim 2 wherein said system is a fuel burner control system further comprising a valve means for controlling the flow of fuel to a burner, and wherein said electrical load comprises a solenoid for opening said valve.

4. A system according to claim 3 wherein said power switch means comprises relay contacts connected between said source and said load, and said closure means comprises a relay winding energized in response to said closure signal to position said contacts in said closed circuit condition.

5. A system according to claim 4 wherein said protective switch means comprises an electronic switch activated into a conductive condition by said closure signal.

6. A system according to claim 3 wherein said power switch means comprises an electronic switch connected between said source and said load and activated into a conductive condition by said closure signal.

7. A system according to claim 6 wherein said protective switch means comprises an auxiliary electronic switch activated into a conductive condition by said closure signal.

8. A system according to claim 1 wherein said sensing circuit means produces an error signal in response to an open condition of said power switch and a simultaneous circuit closed condition of said protective switch means.

9. A system according to claim 8 including shutdown circuit means for deactivating said condition responsive control means in response to either said fault or said error signal.

10. A system according to claim 9 wherein said system is a fuel burner control system further comprising a valve means for controlling the flow of fuel to a burner, and wherein said electrical load comprises a solenoid for opening said valve.

11. A system according to claim 10 wherein said power switch means comprises relay contacts connected between said source and said load, and said closure means comprises a relay winding energized in response to said closure signal to position said contacts in said closed circuit condition.

12. A system according to claim 11 wherein said protective switch means comprises an electronic switch activated into a conductive condition by said closure signal.

13. A system according to claim 10 wherein said power switch means comprises an electronic switch connected between said source and said load and activated into a conductive condition by said closure signal.

14. A system according to claim 13 wherein said protective switch means comprises an auxiliary electronic switch activated into a conductive condition by said closure signal.

15. A system according to claim 1 including an initiator means for energizing said system, and said condition responsive control means comprises time delay means for producing said closure signal a predetermined period after said energization of said system by said initiator means.

16. A system according to claim 15 wherein said sensing means senses the voltage at a point between said power switch means and said protective switch means, and produces said fault signal in response to a level of said voltage above a given maximum value.

17. A system according to claim 16 wherein said sensing means produces an error signal in response to a level of said voltage below a given minimum value.

18. A system according to claim 17 including shutdown circuit means for deactivating said condition responsive control means in response to either said fault or said error signal.

19. A system according to claim 18 wherein said system is a fuel burner control system further comprising a valve means for controlling the flow of fuel to a burner, and wherein said electrical load comprises a solenoid for opening said valve.

* * * * *